United States Patent [19]

Tyus

[11] 4,365,708

[45] Dec. 28, 1982

[54] PROMOTIONAL PHONOGRAPH RECORD ALBUM

[76] Inventor: Philranzo M. Tyus, 18450 Ingomar St., Reseda, Calif. 91335

[21] Appl. No.: 220,767

[22] Filed: Dec. 29, 1980

Related U.S. Application Data

[63] Continuation-in-part of Ser. No. 86,817, Oct. 22, 1979, abandoned.

[51] Int. Cl.[3] ..... B65D 85/57; G11B 3/84

[52] U.S. Cl. ..... 206/309; 206/232; 206/387; 40/18; 40/340

[58] Field of Search ..... 206/307–312, 206/387; 40/17, 18, 340, 359

[56] References Cited

U.S. PATENT DOCUMENTS

| | | | |
|---|---|---|---|
| 369,926 | 9/1887 | Detwiler | 40/18 |
| 1,368,803 | 2/1921 | Johnson | 206/312 |
| 1,423,206 | 7/1922 | Geddes | 40/340 |
| 2,338,651 | 1/1944 | Lowenthal | 40/18 |
| 2,845,732 | 8/1958 | Nichols | 40/18 |
| 3,063,338 | 11/1962 | Bregman | 40/159 |
| 3,191,494 | 6/1965 | Schwartz et al. | 40/340 |
| 3,340,999 | 9/1967 | Froehlig | 206/309 |
| 3,722,564 | 3/1973 | Croon | 206/309 |
| 3,744,150 | 7/1973 | Folson | 206/312 |
| 3,829,132 | 8/1974 | Willieme | 206/387 |
| 3,866,751 | 2/1975 | Holert | 206/387 |
| 4,290,524 | 9/1981 | Alar | 206/232 |

FOREIGN PATENT DOCUMENTS

| | | | |
|---|---|---|---|
| 783277 | 7/1935 | France | 206/312 |
| 1325272 | 3/1963 | France | 206/312 |
| 779108 | 7/1957 | United Kingdom | 206/313 |

*Primary Examiner*—William Price
*Assistant Examiner*—Gary E. Elkins
*Attorney, Agent, or Firm*—Fulwider, Patton, Rieber, Lee & Utecht

[57] ABSTRACT

A phonograph record album used to present promotional music and song recordings to professional artists and writers, comprised of a first compartment for holding a phonograph record, and a coplanar second compartment for holding an information card, with the second compartment having serpentine side guide strips for maintaining lateral alignment of the card as it is moved into and out of its compartment, and flat springs attached between the bottom side of the second compartment and the card to prevent complete removal of the card from its compartment. In an alternate embodiment, the album is comprised of a separable information packet for containing the information card.

6 Claims, 2 Drawing Figures

PROMOTIONAL PHONOGRAPH RECORD ALBUM

BACKGROUND OF THE INVENTION

This application is a continuation-in-part of co-pending application Ser. No. 86,817, filed Oct. 22, 1979, now abandoned.

The present invention relates generally to phonograph record albums, and, more particularly, to phonograph record albums used in the promotion of music and songs.

In the field of music and song promotion, distribution of short playing demonstration records or tapes to radio stations has long been the conventional and most effective manner in which amateur and lesser-known artists and writers received exposure for their musical works. The extent to which the work is exposed, if at all, depends largely on internal decisions of the radio stations involved, with respect to whether, and how frequently, a demonstration record will be played.

Another approach has been to distribute demonstration records or tapes, or sheet music directly to professional artists who are hopefully looking for new materials they can perform. Direct submission is, however, difficult and time consuming, and often does not get the work of the amateur into the hands of professionals actually seeking such works.

Another manner in which amateur and lesser-known artists can receive exposure for their music and songs, without relying on radio stations or direct submissions, is by entry into competition at music festivals which sell records containing a collection of the winning performances. Because of the competitive selection process employed and the limited sales such records usually enjoy, obtaining significant exposure for music and songs in this manner is often ineffective.

It will be apparent from the foregoing that there has long been a need for some means, such as a phonograph record album, that can be utilized to present short playing demonstration records directly to professionals seeking new musical works. The present invention fulfills this need.

SUMMARY OF THE INVENTION

The present invention resides in a phonograph record album that can be utilized to present promotional phonograph records directly to professional song writers, singers or musicians looking for new musical material. Moreover, the exterior surfaces of the album of the invention may be used for the advertisement of goods and services.

The album is constructed with a first compartment for holding a phonograph record and with a second coplanar compartment for holding an information card, the second compartment having side guides for maintaining lateral alignment of the card as it is moved into and out of its compartment and card retention means for preventing complete removal of the card from its compartment.

In the preferred form of the album of the present invention, the side guides are serpentine strips, and the retention means are a plurality of flat springs, attached by their distal ends to the second compartment and the information card.

In another embodiment of the invention, the compartments of the album are separable and the second compartment is an information packet constructed in the manner described above.

Other features and advantages of the invention will become apparent from the following detailed description, taken in conjunction with the accompanying drawings.

DETAILED DESCRIPTION

Figure 1:
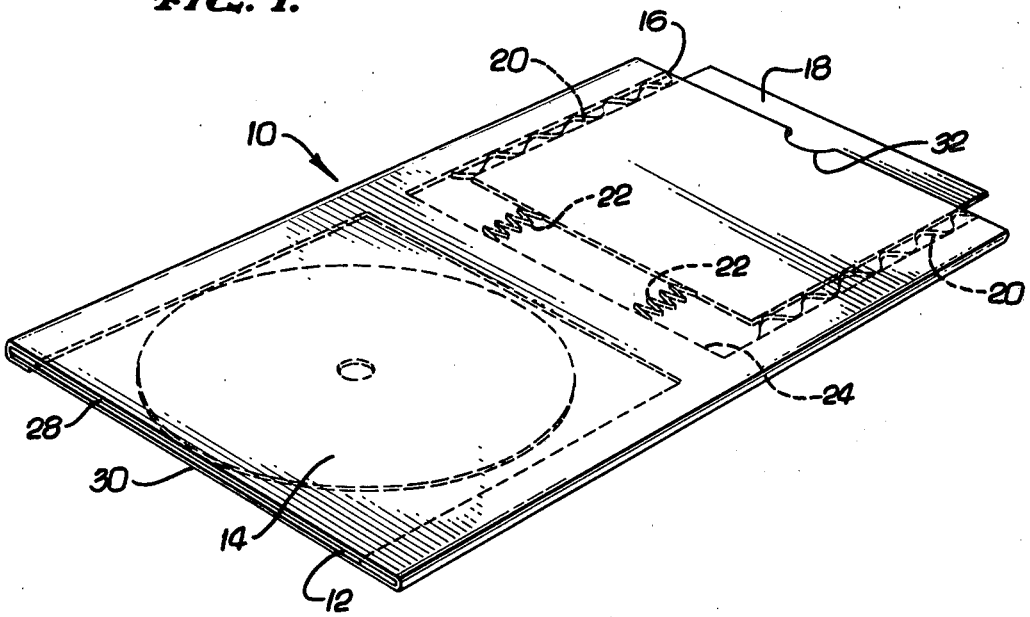
FIG. 1 is a perspective view of an album embodying the present invention.

As shown in the drawings for purposes of illustration, the present invention is embodied in a phonograph record album, indicated generally by reference numeral 10, designed for use in the promotion of music and songs of amateur artists and writers.

In accordance with the invention, the album 10 includes a first compartment 12 for holding a phonograph record 14 which contains music recorded by an amateur artist or writer desiring to make his music or song available to a professional artist or writer who is seeking new works, and a second compartment 16 for holding an information card 18. In the embodiment shown in FIG. 1, the information card 18 is guided within the second compartment 16 by alignment guides 20, and is movably retained within the second compartment by retainers 22.

Each of the compartments 12 and 16 is constructed with three closed sides and an open end from which the compartment's contents can be inserted or removed. The second compartment 16 has a closed bottom side 24, opposite its open end, to which the retainers 22 are fixedly secured. The retainers 22 are also fixedly secured to a side of the information card 18 which is adjacent to the closed bottom side 24, to prevent the complete removal of the card from the second compartment 16 and avoid its theft or accidental loss.

In the presently preferred embodiment of the invention, the retainers 22 are a pair of flat springs each having one of its distal ends attached to the bottom side 24 of the second compartment 16 and the other of its distal ends attached to the information card 18. It is noted, however, that the retainers of the present invention could be coil springs or elastic bands.

To facilitate easy removal and return of the information card 18 from the second compartment 16, the alignment guides 20 are positioned along each of the two closed sides of the second compartment adjacent to its open end and maintain lateral alignment of the card as it is being moved into and out of the second compartment. In the presently preferred embodiment of the invention, the lateral alignment guides 20 are serpentine metallic strips fixedly secured to the two closed sides of the second compartment 16.

Figure 2:
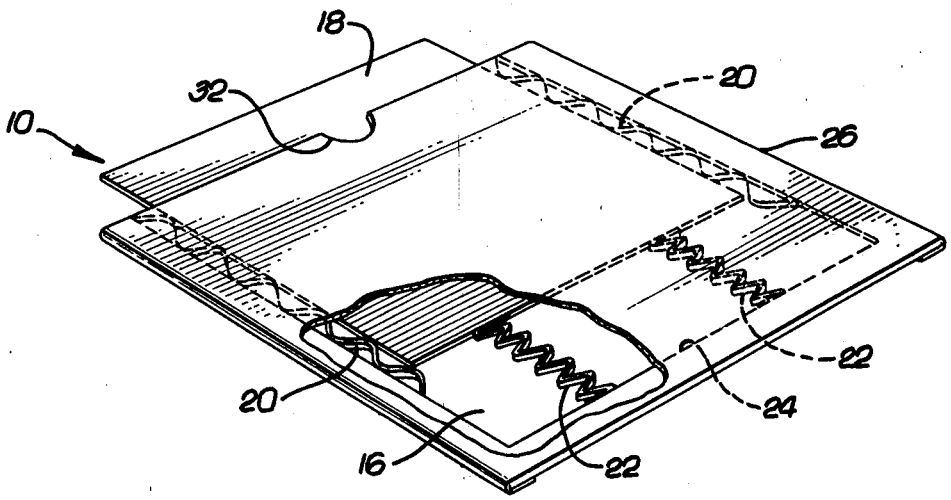
FIG. 2 is a fragmentary, perspective view of an alternate embodiment of the album shown in FIG. 1.

As shown in FIG. 1, the first and second compartments 12 and 16 are coplanar with respect to each other, and have their open ends facing in opposite directions. In the embodiment shown in FIG. 2, the album comprises two separable parts, the first being an information card holder 26 and the second being a record holder (not shown). The card holder 26 has a compartment 16 for holding the information card 18 which, as described above, is guided within the compartment by the alignment guides 20 and is movably retained within the compartment by the retainers 22.

The album 10 is constructed from an upper cover sheet 28 and a lower cover sheet 30 joined together along selected portions of their common sides to form the compartments 12 and 16. A semi-circular section cut 32 is provided along each of the edge portions of the cover sheets 28 and 30 at the open end of the second compartment 16 to facilitate grasping of the information card 18 and to allow its easy removal.

The information card 18 provides a space to present any information necessary to identify the work recorded on the record 14, and any statements or pertinent facts concerning the amateur whose work is recorded or the work itself. The card 18 eliminates the need to put all of this information on the label of the record 14 or on the cover sheets 28 and 30 of the album 10. Furthermore, use of an information card 18 frees the cover sheets 28 and 30 so that they can be used to place advertisements for products or services of a sponsor, as desired.

It will be appreciated from the foregoing description that the present invention represents a significant advance in the field of music and song promotion. In particular, it provides a record album that can be used to make promotional phonograph records available to professionals seeking new works, while simultaneously advertising goods and services. It will also be appreciated that, although specific embodiments of the invention have been described herein for purposes of illustration, various modifications may be made without departing from the spirit and scope of the invention.

I claim:

1. A phonograph record album comprising:

a first compartment for holding a phonograph record; and a second compartment, coplanar with said first compartment, for holding an information card, said second compartment including side guides for maintaining lateral alignment of said card as it is moved into and out of said compartment, and further including card retention means for preventing complete removal of said card from said second compartment.

2. The phonograph album of claim 1, wherein said side guides are serpentine strips.

3. The phonograph record album of claim 1, wherein said card retention means includes a plurality of flat springs, said springs each being attached by its one distal end to said second compartment and attached by its other distal end to said card.

4. A phonograph record album comprising:

a first compartment for holding a phonograph record, said first compartment having an open end through which said record can pass; and a second compartment, coplanar with said first compartment, for holding an information card, said second compartment having an open end through which said card can pass and three closed sides, said open end facing away from said open end of said first compartment, and said second compartment further having side guides extending along two of said closed sides adjacent to said open end of said second compartment for maintaining lateral alignment of said card, and retention means for movable retaining said card within said second compartment.

5. The phonograph record album of claim 4, wherein said lateral side guides are serpentine strips.

6. The phonograph record album of claim 4, wherein said retention means includes a plurality of flat springs, said springs each being attached by its one distal end to said closed side of said second compartment opposite its open end, and attached by its other distal end to said card.

* * * * *